US009518403B1

(12) United States Patent
Tucker

(10) Patent No.: US 9,518,403 B1
(45) Date of Patent: Dec. 13, 2016

(54) COLLAPSIBLE PICNIC TABLE CANOPY DEVICE

(71) Applicant: Rex Tucker, Bloomington, CA (US)

(72) Inventor: Rex Tucker, Bloomington, CA (US)

( * ) Notice: Subject to any disclaimer, the term of this patent is extended or adjusted under 35 U.S.C. 154(b) by 0 days.

(21) Appl. No.: 14/941,180

(22) Filed: Nov. 13, 2015

(51) Int. Cl.

| | |
|---|---|
| ***E04H 15/02*** | (2006.01) |
| ***A47B 37/04*** | (2006.01) |
| ***E04H 15/48*** | (2006.01) |
| ***E04H 15/58*** | (2006.01) |

(52) U.S. Cl.
CPC ..... *E04H 15/02* (2013.01); *A47B 37/04* (2013.01); *E04H 15/48* (2013.01); *E04H 15/58* (2013.01)

(58) Field of Classification Search
CPC ..... A47B 37/04; E04H 15/02; E04H 15/58; E04H 15/48
USPC . 135/145, 90, 157, 158, 160, 96; 108/50.11, 50.12
See application file for complete search history.

(56) References Cited

U.S. PATENT DOCUMENTS

| | | | | |
|---|---|---|---|---|
| 923,021 | A * | 5/1909 | Condon | B62B 9/14 135/145 |
| 2,341,672 | A * | 2/1944 | Terrill | A47B 71/00 108/42 |
| 2,790,452 | A * | 4/1957 | Dusek | E04H 15/04 108/42 |
| 3,101,731 | A * | 8/1963 | Stiglin | A45B 23/00 135/143 |
| 3,176,699 | A | 4/1965 | Rollins | |
| 3,221,756 | A | 12/1965 | Rupright | |
| 3,233,618 | A | 2/1966 | Ferrier | |
| 3,303,851 | A * | 2/1967 | Grunfeld | E04H 4/108 135/115 |
| 3,338,252 | A | 8/1967 | Strom | |
| 3,383,127 | A | 5/1968 | Grunfeld | |
| 3,744,500 | A * | 7/1973 | Briggs | A47C 29/006 135/140 |
| 3,890,989 | A * | 6/1975 | Kuxhouse | A45B 25/02 135/133 |
| D279,833 | S | 7/1985 | Eberle | |
| 4,724,882 | A * | 2/1988 | Wang | E04F 10/0614 135/117 |
| 6,276,382 | B1 | 8/2001 | Bindschatel et al. | |
| 6,866,054 | B1 | 3/2005 | Collins | |
| 7,258,310 | B2 * | 8/2007 | Norris | A61G 5/10 248/125.7 |
| 7,896,015 | B2 | 3/2011 | Milano, Jr. et al. | |
| 8,056,874 | B2 * | 11/2011 | Goodwin | A61G 5/10 248/276.1 |
| 9,140,406 | B2 * | 9/2015 | Simon | |
| 2004/0094676 | A1 * | 5/2004 | Cuomo | A61C 19/00 248/125.7 |

FOREIGN PATENT DOCUMENTS

| | | | | |
|---|---|---|---|---|
| DE | 202012012585 U1 * | 6/2013 | | A47B 37/04 |

* cited by examiner

*Primary Examiner* — Noah Chandler Hawk

(57) ABSTRACT

A collapsible picnic table canopy device removably attaches a canopy to an existing picnic table. The device includes a pair of support posts each having a top end and a bottom end. A frame is coupled and extends between the support posts. The frame is selectively expandable and collapsible. A canopy is coupled to the frame such that the canopy covers the frame. Each of a pair of clamps is positioned at the bottom end of a respective one of the support posts wherein the support posts are configured for being coupled to a picnic table such that the canopy is supported over the picnic table.

9 Claims, 4 Drawing Sheets

COLLAPSIBLE PICNIC TABLE CANOPY DEVICE

BACKGROUND OF THE DISCLOSURE

Field of the Disclosure

The disclosure relates to canopy devices and more particularly pertains to a new canopy device for removably attaching a canopy to an existing picnic table.

SUMMARY OF THE DISCLOSURE

An embodiment of the disclosure meets the needs presented above by generally comprising a pair of support posts each having a top end and a bottom end. A frame is coupled and extends between the support posts. The frame is selectively expandable and collapsible. A canopy is coupled to the frame such that the canopy covers the frame. Each of a pair of clamps is positioned at the bottom end of a respective one of the support posts wherein the support posts are configured for being coupled to a picnic table such that the canopy is supported over the picnic table.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
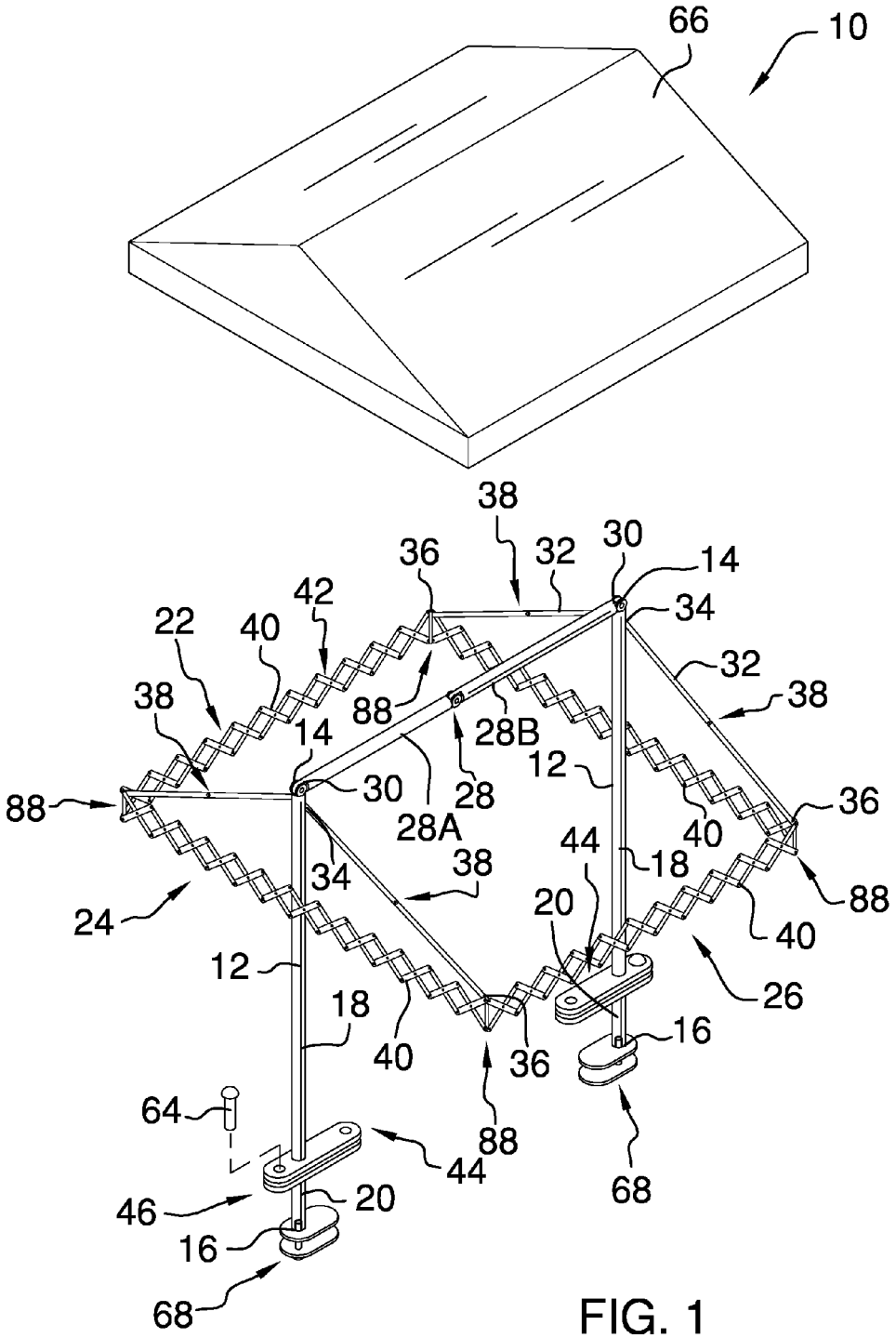
FIG. 1 is a partially exploded top front side perspective view of a collapsible picnic table canopy device according to an embodiment of the disclosure.
Figure 2:
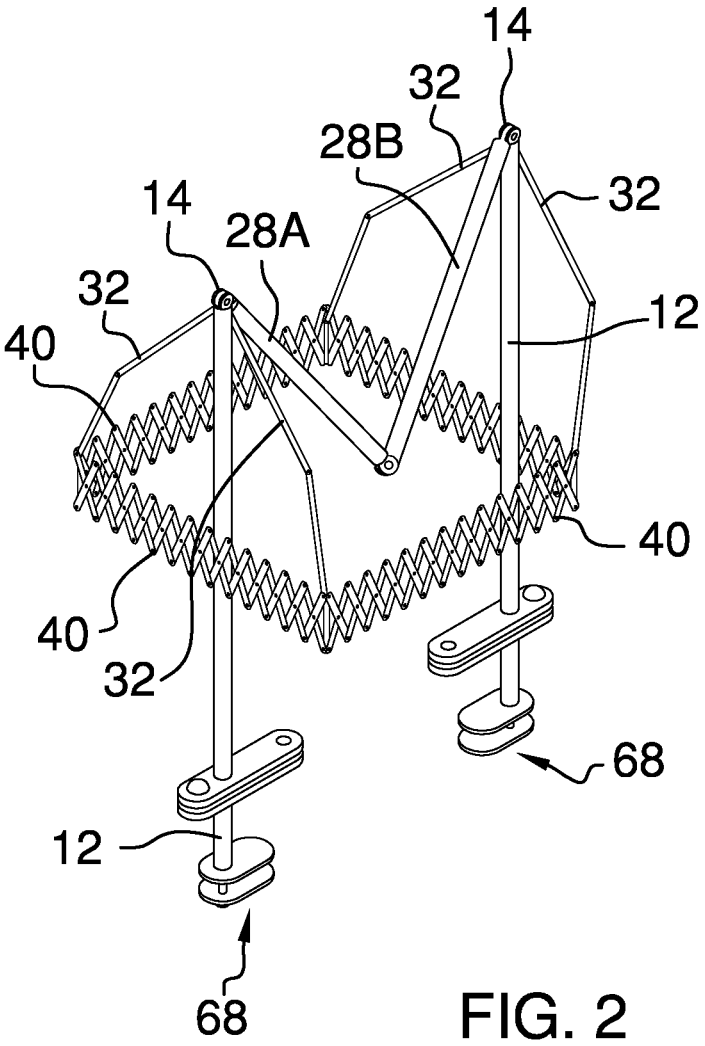
FIG. 2 is a partial top front side perspective view of an embodiment of the disclosure in a collapsed position.
Figure 3:
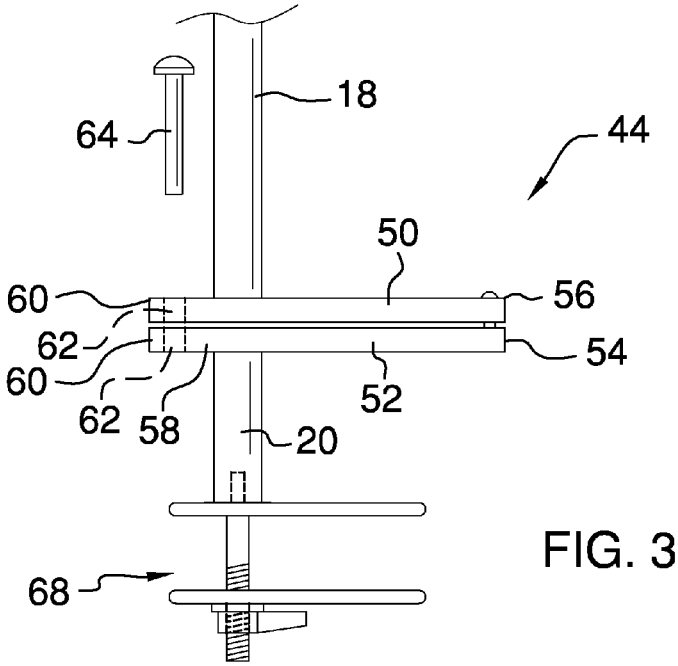
FIG. 3 is a detailed side view of an offset mechanism of an embodiment of the disclosure in a first position.
Figure 4:
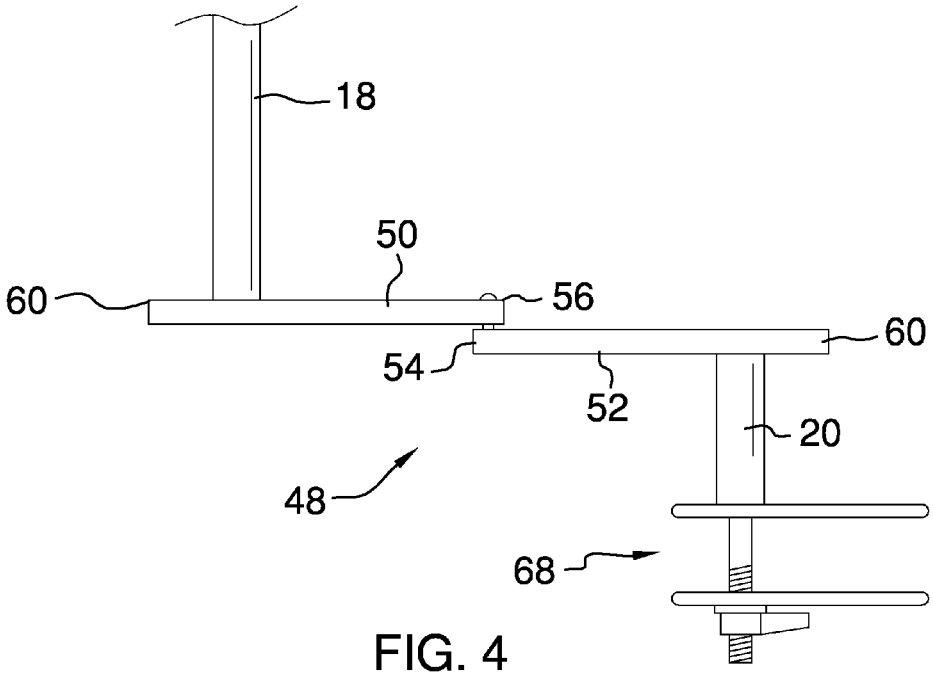
FIG. 4 is a detailed side view of an offset mechanism of an embodiment of the disclosure in a second position.
Figure 5:
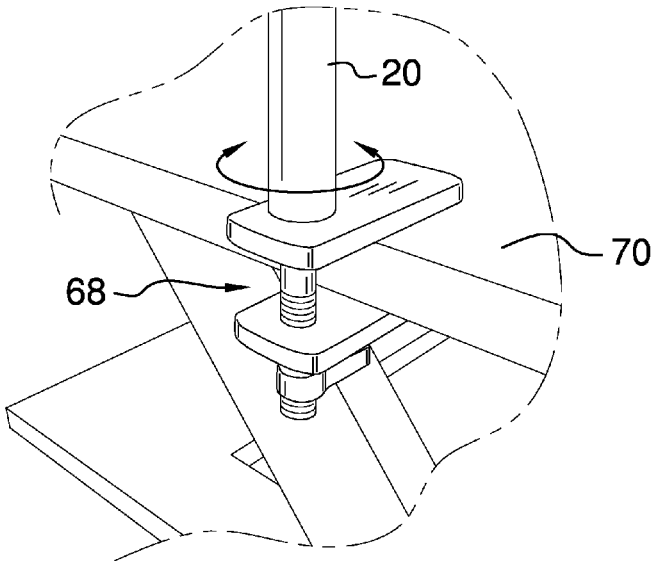
FIG. 5 is a detailed view of a clamp of an embodiment of the disclosure in use.
Figure 6:
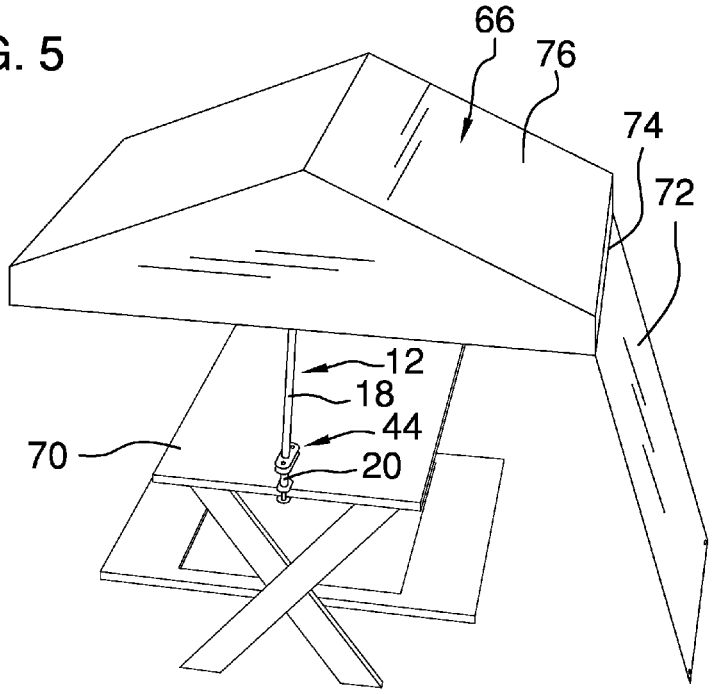
FIG. 6 is a top front side perspective view of an embodiment of the disclosure in use.

With reference now to the drawings, and in particular to FIGS. 1 through 6 thereof, a new canopy device embodying the principles and concepts of an embodiment of the disclosure and generally designated by the reference numeral 10 will be described.

As best illustrated in FIGS. 1 through 6, the collapsible picnic table canopy device 10 generally comprises a pair of support posts 12. Each of the support posts 12 has a top end

14 and a bottom end 16. Each support post 12 has an upper section 18 and a lower section 20. A frame 22 is coupled to the support posts 12. The frame 22 is coupled to and extends between the support posts 12. The frame 22 is selectively expandable and collapsible. The frame 22 has a pair of short end sections 24 and a pair of long lateral sections 26 wherein the frame 22 defines a rectangular peripheral shape. The frame 22 has a longitudinal length between 2 meters and 3 meters when fully extended. The longitudinal length may correspond to a length of a conventional picnic table 70 commonly having a length of approximately 8 feet or 2.45 meters. The frame 22 comprises a central bar 28 having opposite ends 30. Each of the opposite ends 30 of the central bar 28 is coupled to the top end 14 of an associated one of the support posts 12. The central bar 28 has a pair of sections 28A, 28B pivotally coupled together wherein the central bar 28 is collapsible. Each of a plurality of extension bars 32 has an upper end 34 and a lower end 36. The upper end 34 of each extension bar 32 is coupled to the top end 14 of an associated one of the support posts 12. Each extension bar 32 has a medial pivot 38 wherein each extension bar 32 is collapsible. A plurality of scissor arms 40 defines a periphery 42 of the frame 22. The lower end 36 of each extension bar 32 is coupled to a junction 88 between adjacently positioned scissor arms 40.

Each of a pair of offset mechanisms 44 is coupled to an associated one of the support posts 12. Each offset mechanism 44 couples the upper section 18 to the lower section 20 of the associated one of the support posts 12 such that the lower section 20 is selectively positionable between a first position 46 in alignment with the upper section 18 and a second position 48 offset from the upper section 18. The lower section 20 of each support post 12 is offset from the upper section 18 of the support post 12 a length between 0.5 and 0.7 meters when the offset mechanism 44 is in the second position 48. Thus, the frame 22 may be used in a fully expanded position while the bottom ends 16 of the support posts 12 are positionable to correspond to larger or smaller picnic tables. Each offset mechanism 44 comprises a first arm 50 fixedly coupled to the upper section 18 of the associated support post 12. The first arm 50 extends inwardly relative to the frame 22 such that the frame 22 is positioned extending over the first arm 50. A second arm 52 has a first end 54 pivotally coupled to a distal end 56 of the first arm 50 relative to the associated support post 12. The second arm 52 has a second end 58 coupled to the lower section 20 of the associated support post 12. Each of a pair of extensions 60 is coupled to and extends from an associated one of the first arm 50 and the second arm 52. The extensions 60 overlap in the first position 46. Each extension 60 has a respective aperture 62 extending therethrough. The apertures 62 are aligned in the first position 46. A locking pin 64 is insertable through the apertures 62 in the extensions 60 wherein the locking pin 64 secures the offset mechanism 44 in the first position 46.

A canopy 66 is coupled to the frame 22 such that the canopy 66 covers the frame 22. The canopy 66 is drawn tight to the frame 22 when the frame 22 is in a fully expanded position. The canopy 66 may include an additional panel 72 extendable from a lateral edge 74 of a main section 76. The additional panel 72 may be secured in a conventional manner to extend down from the main section 76 and provide additional wind blockage or shade.

Each of a pair of clamps 68 is positioned at the bottom end 16 of a respective one of the support posts 12 wherein the support posts 12 are configured for being coupled to the picnic table 70 such that the canopy 66 is supported over the picnic table 70. Each clamp 68 is rotatably coupled to the bottom end 16 of the associated one of the support posts 12 wherein the clamp 68 is configured for being rotated to face the picnic table 70 in both the first position 46 and the second position 48 of the offset mechanism 44. Each of the clamps 68 is of a conventional design capable of being secured to the picnic table 70 in a conventional manner.

In use, the offset mechanisms 44 are positioned as desired to position the clamps 68 for being secured to the picnic table 70. The offset mechanisms 44 allow for adjustment between standard picnic table sizes which may be between 6 and 8 feet in length. The support posts 12 are spread expanding the frame 22 and allowing the clamps 68 to be secured to the picnic table 70 wherein the canopy 66 is positioned over the picnic table 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible picnic table canopy device comprising:

a pair of support posts, each of said support posts having a top end and a bottom end;

a frame coupled to said support posts, said frame extending between said support posts, said frame being selectively expandable and collapsible;

a canopy coupled to said frame such that said canopy covers said frame;

a pair of clamps, each clamp being positioned at said bottom end of a respective one of said support posts wherein said support posts are configured for being coupled to a picnic table such that said canopy is supported over the picnic table; and wherein said frame further comprises a central bar having opposite ends, each of said opposite ends of said central bar being coupled to a top end of an associated one of said support posts, said central bar having a pair of sections pivotally coupled together wherein said central bar is collapsible;

a plurality of extension bars, each extension bar having an upper end and a lower end, said upper end of each extension bar being coupled to an associated one of said top ends of said support posts, each said extension bar having a medial pivot wherein each said extension bar is collapsible; and a plurality of scissor arms defining a periphery of said frame, said lower end of each said extension bar being coupled to a junction between adjacently positioned said scissor arms.

2. The device of claim 1, further comprising said canopy being drawn tight to said frame when said frame is in a fully expanded position.

3. The device of claim 1, further comprising said frame having a pair of short end sections and a pair of long lateral sections wherein said frame defines a rectangular peripheral shape.

4. The device of claim 3, further comprising said frame having a longitudinal length between 2 meters and 3 meters.

5. The device of claim 1, further comprising:

each said support post having an upper section and a lower section; and a pair of offset mechanisms, each offset mechanism being coupled to an associated one of said support posts, each said offset mechanism coupling said upper section to said lower section of an associated one of said support posts such that said lower section is selectively positionable between a first position in alignment with said upper section and a second position offset from said upper section.

6. The device of claim 5, wherein each said offset mechanism further comprises:

a first arm fixedly coupled to said upper section of said associated support post, said first arm extending inwardly relative to said canopy such that said canopy is positioned extending over said first arm, and a second arm having a first end pivotally coupled to a distal end of said first arm relative to said associated support post, said second arm having a second end coupled to said lower section of said associated support post; and a pair of extensions, each said extension being coupled to and extending from an associated one of said first arm and said second arm, said extensions overlapping in said first position, each said extension having a respective aperture extending therethrough, said apertures being aligned in said first position; and a locking pin extendable through said apertures in said extensions wherein said locking pin secures said offset mechanism in said first position.

7. The device of claim 6, further comprising each said clamp being rotatably coupled to said bottom end of said associated one of said support posts wherein said clamp is configured for being rotated to face the picnic table in both said first position and said second position.

8. The device of claim 5, further comprising said lower section of each said support post being offset from said upper section of said support post a length between 0.5 and 0.7 meters when said offset mechanism is in said second position.

9. A collapsible picnic table canopy device comprising:

a pair of support posts, each of said support posts having a top end and a bottom end, each said support post having an upper section and a lower section;

a frame coupled to said support posts, said frame extending between said support posts, said frame being selectively expandable and collapsible, said frame having a pair of short end sections and a pair of long lateral sections wherein said frame defines a rectangular peripheral shape, said frame having a longitudinal length between 2 meters and 3 meters, said frame comprising a central bar having opposite ends, each of said opposite ends of said central bar being coupled to a top end of an associated one of said support posts, said central bar having a pair of sections pivotally coupled together wherein said central bar is collapsible, a plurality of extension bars, each extension bar having an upper end and a lower end, said upper end of each extension bar being coupled to an associated one of said top ends of said support posts, each said extension bar having a medial pivot wherein each said extension bar is collapsible, and a plurality of scissor arms defining a periphery of said frame, said lower end of each said extension bar being coupled to a junction between adjacently positioned said scissor arms;

a pair of offset mechanisms, each offset mechanism being coupled to an associated one of said support posts, each said offset mechanism coupling said upper section to said lower section of an associated one of said support posts such that said lower section is selectively positionable between a first position in alignment with said upper section and a second position offset from said upper section, said lower section of each said support post being offset from said upper section of said support post a length between 0.5 and 0.7 meters when said offset mechanism is in said second position, each said offset mechanism comprising a first arm fixedly coupled to said upper section of said associated support post, said first arm extending inwardly relative to said frame such that said frame is positioned extending over said first arm, a second arm having a first end pivotally coupled to a distal end of said first arm relative to said associated support post, said second arm having a second end coupled to said lower section of said associated support post, a pair of extensions, each said extension being coupled to and extending from an associated one of said first arm and said second arm, said extensions overlapping in said first position, each said extension having a respective aperture extending therethrough, said apertures being aligned in said first position, and a locking pin extendable through said apertures in said extensions wherein said locking pin secures said offset mechanism in said first position;

a canopy coupled to said frame such that said canopy covers said frame, said canopy being drawn tight to said frame when said frame is in a fully expanded position; and a pair of clamps, each clamp being positioned at said bottom end of a respective one of said support posts wherein said support posts are configured for being coupled to a picnic table such that said canopy is supported over the picnic table, each said clamp being rotatably coupled to said bottom end of said associated one of said support posts wherein said clamp is configured for being rotated to face the picnic table in both said first position and said second position.

* * * * *